US006693233B1

(12) United States Patent
Sewell

(10) Patent No.: US 6,693,233 B1
(45) Date of Patent: Feb. 17, 2004

(54) NECKLESS LAP GUITAR

(76) Inventor: David L. Sewell, 527 Northport Dr., Apt. 3, Madison, WI (US) 53704

( * ) Notice: Subject to any disclaimer, the term of this patent is extended or adjusted under 35 U.S.C. 154(b) by 0 days.

(21) Appl. No.: 10/378,349

(22) Filed: Mar. 3, 2003

(51) Int. Cl.[7] ..... G10D 3/00
(52) U.S. Cl. ..... 84/291; 84/290; 84/267
(58) Field of Search ..... 84/291, 274, 290, 84/267, 292, 268, 269; 445/408

(56) References Cited

U.S. PATENT DOCUMENTS

| | | | | |
|---|---|---|---|---|
| 72,591 | A | | 12/1867 | Bini |
| D28,340 | S | | 3/1898 | Baehr |
| 636,692 | A | | 11/1899 | Patch |
| 989,510 | A | | 4/1911 | McCullough |
| 1,183,369 | A | | 5/1916 | Gardie |
| 1,304,914 | A | | 5/1919 | Smith |
| 1,335,010 | A | | 3/1920 | Morris |
| 1,364,217 | A | | 1/1921 | Surratt |
| 1,426,852 | A | | 8/1922 | Frozeth |
| 1,768,261 | A | | 6/1930 | Larson |
| 1,834,804 | A | | 12/1931 | Puoina |
| 1,839,244 | A | | 1/1932 | Meisel |
| 1,889,408 | A | | 11/1932 | Larson |
| 2,449,124 | A | | 9/1948 | Kimmons |
| 2,800,050 | A | | 7/1957 | Gregg et al. |
| 3,561,314 | A | | 2/1971 | MacEachron |
| 3,685,385 | A | | 8/1972 | Rendell |
| 3,853,032 | A | | 12/1974 | Freeman |
| 3,892,159 | A | | 7/1975 | Houtsma |
| 3,974,730 | A | | 8/1976 | Adams, Jr. |
| 4,576,080 | A | * | 3/1986 | McLellan et al. ..... 84/267 |
| 4,881,441 | A | | 11/1989 | Larsen |
| 5,339,718 | A | | 8/1994 | Leduc |
| 5,406,874 | A | | 4/1995 | Witchel |
| 5,469,770 | A | | 11/1995 | Taylor |
| D384,689 | S | | 10/1997 | Najarian |
| 5,811,704 | A | | 9/1998 | Anderko |
| 5,895,872 | A | | 4/1999 | Chase |
| 5,952,592 | A | | 9/1999 | Teel |
| D415,517 | S | | 10/1999 | Hagerman et al. |
| 6,166,308 | A | | 12/2000 | Lam |
| 6,459,024 | B1 | | 10/2002 | Baker |

OTHER PUBLICATIONS

Egyptian Oud—http://www.apollosaxes.com/egyptianoud.html (Oct. 25, 2002).
Out—http://www.apollosaxes.com/oud.html (Oct. 25, 2002).
Lute—http://www.apollosaxes.com/lute.html (Oct. 25, 2002).
Laouta—http://www.apollosaxes.com/laouta.html (Oct. 25, 2002).
Mandolin from Amigo—http://apollosaxes.com/manfromam.htm. (Oct. 25, 2002).
Dilruba—http://www.buckinghammusic.com/dilruba/dilruba.html (Oct. 25, 2002).
Sarode—http://www.buckinghammusic.com/sarod.sarod.html (Oct. 25, 2002).

* cited by examiner

*Primary Examiner*—Kimberly Lockett
(74) *Attorney, Agent, or Firm*—LaFollette Godfrey & Kahn; Sonali S. Srinivastava

(57) ABSTRACT

A neckless guitar including a guitar body forming a tear shaped acoustic chamber. The guitar includes a peg head with at least one receiving slot for a tuning key. The peg head is directly attached to the top end of the acoustic chamber such that no neck-region is formed. The neckless guitar has a fret board, a saddle assembly and a nut assembly, at least one tuning key and at least one string that originates at the saddle assembly, passes over the fret board and through or over the nut assembly, and is connected to the tuning key. In one embodiment, the neckless guitar has an attachment assembly for removably connecting the guitar body and the peg head. The attachment assembly includes a peg head block positioned at the top end of the body. A gusset on the peg head couples the peg head block and the peg head.

15 Claims, 4 Drawing Sheets

NECKLESS LAP GUITAR

BACKGROUND OF THE INVENTION

This invention generally relates to the field of stringed instruments. Specifically, the invention relates to a neckless lap acoustic guitar and a novel attachment assembly for connecting the guitar body to its head.

In the field of music there are numerous stringed instruments, for example, violins, cellos, electric guitars, acoustic guitars, sitars, etc. Each of these instruments creates a variety of sounds, and the variety of sounds in turn creates richness and diversity in the world of acoustics. A person trained in music, however, can differentiate one sound made by these instruments from another, even if the same note is played on different instruments. For example, a musician can differentiate a note played on a violin from a note played on a viola based on methods for playing the instruments, the length of strings, diversity of acoustic chambers, quality of sound created through varying resonance, quality of tone, timbre and amplitude of sound, among others.

Similarly, in the field of guitars, a musician can differentiate the sounds made by different guitars based on the above mentioned factors. Many inventors have successfully altered the sound quality of these guitars by altering their shape, size and design. The art of guitar-making, however, specifically, the art of making acoustic guitars, has remained relatively unchanged for the past 250 years. Small improvements have been made in the bracing and neck block structure to help prevent flexing at the sound box (also referred to as acoustic box, acoustic chamber and sound chamber) and at the neck joint. Other improvements have been made to alter the sound by creating different shaped sound boxes or acoustic chambers.

For example, in a Dulcimer, U.S. Pat. No. 3,561,314, a substantially rectangular sound box is used to create a variation in timbre, resonance, tone quality and amplitude of sound. Yet another construction of a sound box is demonstrated in Kimmon's three stringed musical instrument as found in U.S. Pat. No. 2,499,124. Kimmon's sound box is constructed of a flat top 9, a flat bottom 10, and continuous curved side wall 11. These elements combine to form the body 8, which is enlarged adjacent the tail end thereof, rounded at the end, and tapered gradually toward its opposite, neck end. (Col. 1, lines 53–56 and Col. 2 lines 1–3). The finger board 14 is provided with depending end portions 15 and 16, which rest upon the top 9, adjacent to the end thereof, for supporting the intermediate undercut portion 17 of the finger board 14 in spaced apart relationship to and over the body 8. (Col. 2, lines 14–20). This instrument is played by a pick or a plectrum.

The stringed instrument in U.S. Pat. No. 1,304,914 depicts a lap or tabletop instrument, wherein the sound box includes an arch for the greater portion of the length of the instrument and for the full width thereof. (Lines 58–70). Freeman's violin, U.S. Pat. No. 3,853,032 has a sound chamber that has an exterior shape substantially in the shape of a baseball bat. Psaltery, U.S. Des. Pat. No. 415,517, a design patent, appears to show an acoustic chamber, apparently contained in its entirety along the design of the stringed instrument.

Other variations in sound boxes are found in U.S. Pat. No. 1,839,244 for a combined neckless guitar-mandolin, a double or twin stringed instrument such as a mandolin as shown in U.S. Pat. No. 2,800,050, a stringed musical instrument or an acoustic guitar as found in U.S. Pat. No. 5,895,872, and stringed musical instruments as found in U.S. Pat. Nos. 1,364,217; 1,335,010; Des. 28,340; 636,692; 989,510; Des. 384,689, 5,811,704, and 1,426,852, among others.

There are numerous stringed instruments worldwide that have different sound boxes such as a Sarod, a Dilruba, an Israj, a Sarangi, a Sitar, an Oud, a Lute, an Egyptian Oud, an Amigo Mandolin, an Turkish Laouta, etc. The differences in the sound quality and timbre of all these instruments are attributable to various factors, including variations in shape, size, and construction of the sound boxes among other previously discussed factors. However, more musical instruments are desirable, wherein the sound boxes or acoustic chambers are contoured in a manner such that unique timbre, resonance, tonal quality and sound amplitude are created. While creating various contours for acoustic chambers, it is important that the frame remains stable and does not yield to torsion created by tense strings, mostly spread across the surface of the acoustic boxes.

Frequently, these instruments need repair because of several factors, including the fact that the torsion of strings on the surface flexes, buckles, opens or warps the sound chamber and alters the sound produced from it. When the instruments need any repair, the entire instrument has to be undone and unglued, such that those necessary repairs may be performed. Such a repair is often expensive and consumes an inordinate amount of time.

Accordingly, the need exists for creating a new musical instrument with a different sound quality. Additionally the need exists to create a novel instrument, wherein the acoustic chamber has a stable frame that does not buckle or flex and break under the torsional forces of the attached strings. Finally the need exists for an instrument in which efficient and effective repair may be performed without dismantling the entire body when the instrument is damaged, broken or unglued.

SUMMARY OF THE INVENTION

The novel neckless guitar generally includes a guitar body that is essentially tear-shaped in front view, with a front side and a back side that are essentially parallel to each other. The tear-shaped acoustic chamber is formed within this body, and the inner surface of the chamber conforms substantially to the outer surface of the body. The guitar body has a rounded a bottom end, and opposite to the bottom end is a narrow top end. A peg head having at least one receiving slot is attached to the top end of the guitar body such that no neck region is formed. The neckless guitar has a fret board that is mounted on its front side and is positioned between an opening formed in the front side, and the top end of the chamber. There is a saddle assembly mounted on the front side for placing one end of at least one string. Each string is held at the opposite end by a tuning key, which in turn passes through the respective receiving slot. Each string also passes over a nut assembly placed at the top end of the body.

In one embodiment of the present invention, a neckless guitar has an attachment assembly for connecting a guitar body to the peg head. A peg head block is positioned on the top end of the guitar body and a gusset couples the peg head block and the peg head.

Various other features, objects, and advantages of the invention will be apparent to those skilled in the art from the following detailed description including illustrative examples setting forth how to make and use the invention.

DETAILED DESCRIPTION OF THE INVENTION

Figure 1:
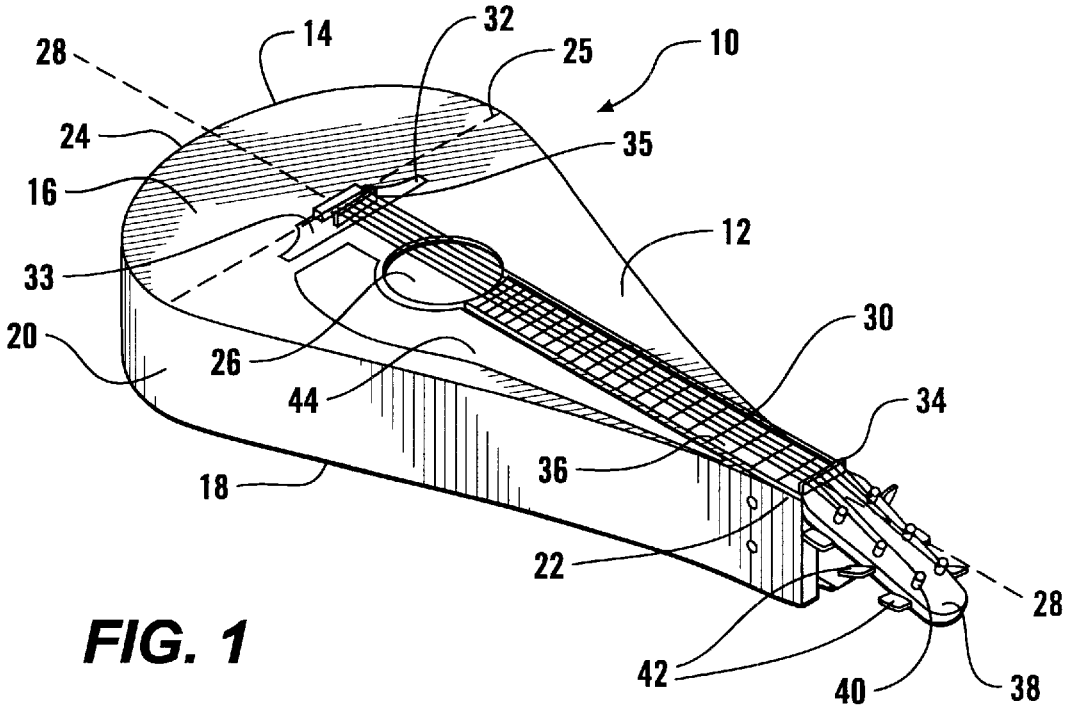
FIG. 1 is a perspective view of a neckless lap guitar constructed according to a preferred embodiment of the invention.
Figure 2:
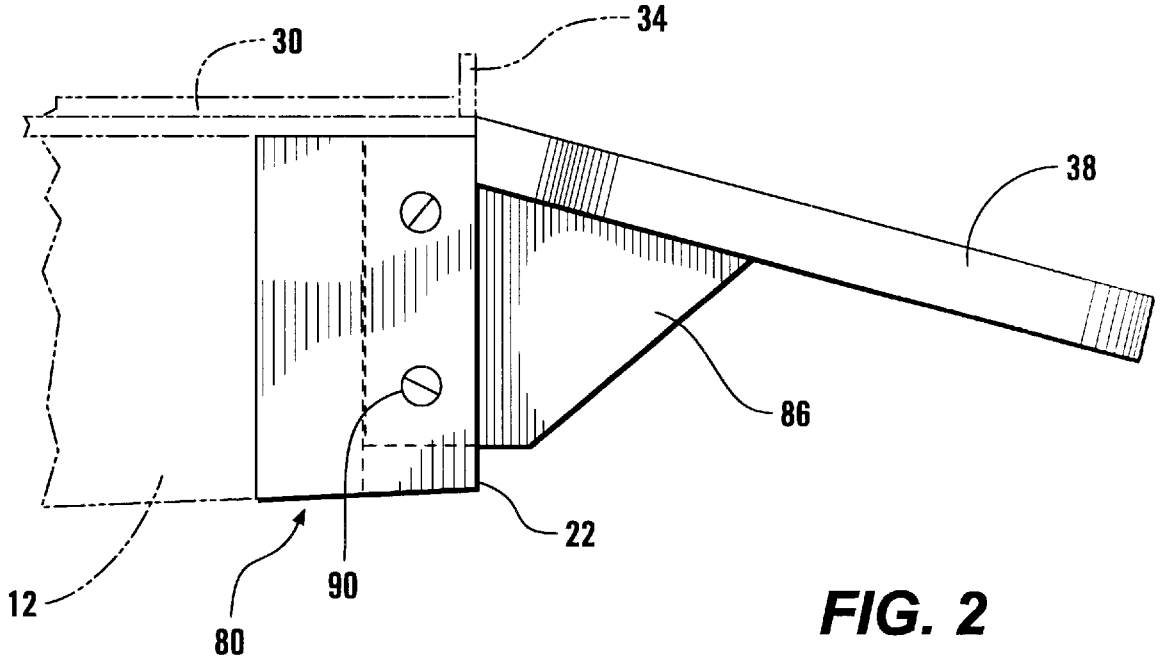
FIG. 2 is an enlarged side elevational view of the top end of the guitar embodiment shown in FIG. 1, depicting the peg head block and the peg head.

The invention is generally described in various embodiments. Some embodiments are illustrated in FIGS. 1–6. Now referring to FIG. 1, neckless guitar 10 is generally made of wood, including rosewood, curly maple, spruce, pine, black and white gritted maple, or padauk, although various other materials may be used, such as steel, plastic, and combinations thereof. The body 12 of the guitar 10 comprises a tear shaped acoustic chamber 14. This chamber 14 is assembled together in one embodiment by at least three pieces of any material listed above. The chamber 14 is preferably constructed primarily from wood comprising the first surface 16, a second surface 18 and sides 20. The chamber 14 in another embodiment may be constructed from at least two pieces of material listed above wherein the sides 20 are fused either with the first surface 16 or the second surface 18. The fused member, for example, is made from a single piece of wood. The remaining side, i.e. second surface 18 and the first surface 16, respectively are then attached to the fused member. In yet another embodiment, the sides 20, the first surface 16 and the second surface 18 are all fused to form the tear shaped acoustic chamber 14. For example, the sides 20, the first surface 16 and the second surface 18 are all made from a single piece of wood. The chamber 14 further comprises a top end 22 and a bottom end 24.

In a preferred embodiment, the tear shaped acoustic chamber 14 is generally 76 cm in length. The width of the chamber 14 generally at the top end 22 is 5 cm. The maximum width 25 of the chamber 14 is generally 37 cm. The sides 20 generally have a maximum height of 12 cm towards the bottom end 24 of the guitar, while the minimum height of the sides 20 towards the top end 22 is generally 10 cm. The sides 20 curve in substantially tear shape such that the maximum angular deviation from the top end 22 of the guitar 10 to the point of maximum width 25 of the chamber 14 is generally 10°. In this preferred embodiment, the tear shape of the chamber 14 is obtained when the first surface 16, the second surface 18 and the sides 20 observe a gradual angular increase from the top end 22 towards the maximum width 25 of the guitar body 12, where the preferred maximum angle is generally 10° and the distance between the top end 22 and the maximum width point 25 is generally 60 cm.

The first surface 16 and the second surface 18 are positioned relative to each other in an orientation such that the two surfaces are substantially parallel to each other. The first surface 16 is generally flat in shape and has a generally circular opening 26 positioned such that the opening 26 is bisected by the longitudinal axis along the line 28–28', which divides the acoustic chamber into two substantially symmetrical halves. In a preferred embodiment, the opening 26 is generally 10 cm in diameter. In one embodiment, the second surface 18 is slightly curved, such that the slight arch improves the torsion-resistance of the acoustic chamber 14. In one embodiment, the second surface 18 is slightly curved in a convex shape, wherein the maximum angular deviation about its horizontal plane is about 10°.

Further, the chamber 14 has a fret board 30, which is mounted on the first surface 16, such that the fret board 30 is positioned between the top end 22 and the opening 26. In one embodiment, the fret board 30 is generally not curved. In another embodiment, the fret board 30 is directly glued to the acoustic chamber 14. In yet another embodiment, the fret board 14 is held in position with either nails or nuts and bolts. In a preferred embodiment, the fret board 30 is a cuboid with generally the following dimensions: 41 cm in length, 5 cm in width and 0.5 cm in depth.

On one side of the fret board 30, the guitar has a saddle assembly 32. Additionally, on one side of the fret board 30, towards the top end 22 of the chamber 14, the guitar 10 has a nut assembly 34. In a preferred embodiment, the nut assembly 34 is cuboid in shape and has the following dimensions: generally 2 cm in height, 5 cm in length and 0.5 cm in depth. In yet another preferred embodiment, the saddle assembly 32 generally comprises a saddle base 33 for receiving at least one string head (not shown). The base 33 further comprises a substantially rectangular bridge 35. In a preferred embodiment, the substantially rectangular bridge 35 has the following dimensions: generally 7 cm in length, 1 cm in height and 0.3 cm in depth. The bridge 35 is angularly positioned on the base 33. The angular position of the bridge 35 allows the guitar 10 to compensate for tonal quality variations caused by varying thickness of strings 36. In a preferred embodiment, strings 36 of varying thickness are used on the fret board 30, starting with the thinnest string 36 on one end to progressively increasing such that the thickest string 36 is at the opposite end. In this preferred embodiment, the tonal quality adjustment is made by positioning the bridge 35 at a preferred angle of about 5° from the base line of the bridge 35. The angular position of the bridge 35 causes the thinnest string 36 to have a vibrating length that is about 1 cm less than the thickest string at the opposite end. In another preferred embodiment, the tonal quality of the strings 36 is adjusted by creating a curvature on the top surface of the fret board 30.

The saddle assembly 32 is constructed such that the base 33 is capable of receiving at least one string 36. In one embodiment of the present invention, the base 33 is capable of receiving at least six strings. The guitar 10 also has a peg head 38 mounted on the top end 22 of the guitar 10 such that in one embodiment, the peg head is positioned at about 15° angle from the horizontal plane of the first surface 16. The peg head 38 has at least one receiving slot 40 for receiving a tuning key 42. In one embodiment of the present invention, the peg head 38 has at least six receiving slots 40 and each of those six receiving slots 40 receive one tuning key 42 each.

The strings 36 originate at the base 33 of the saddle assembly 32, pass through or pass over the rectangular bridge 35, pass through or pass over the nut assembly 34, and are connected to the tuning key 42. Each tuning key 42 is positioned on the head 38 such that each string 36 is capable of being tied to the tuning key 42 such that no one string overlaps or crosses another string's 36 path. The tuning key 42 is used for tuning the string 36 at the appropriate sound frequency based on a desired note. The key 42 may be tightened or loosened to adjust the tension of any given string 36.

In order to play the guitar 10, a person may put the guitar 10 on his or her lap and pick at least one string 36 of the guitar 10, about the circular opening 26 with the aid of a pick or a plectrum (not shown). Variations in notes are made by the aid of a weight (not shown) that is slidable on the string 36. The weight may be constructed from any natural, man-made or synthetic material, including steel, granite, Teflon, wood, etc.

In one embodiment of the present invention, the guitar 10 further comprises a scratch guard 44 that substantially runs along the length of the fret board 30 and partially covers the area around the opening 26. The scratch guard 44 may be constructed from any material including natural, man-made and synthetic materials, such as plastics, wood and combinations thereof. The scratch guard 44 prevents the scratching and wear and tear of the guitar surface when the weight and the plectrum or pick accidentally hit the first surface 16. Additionally, the scratch guard also provides a smooth surface for fingers to glide on while holding the weight and sliding the weight on the string 36.

Figure 6:
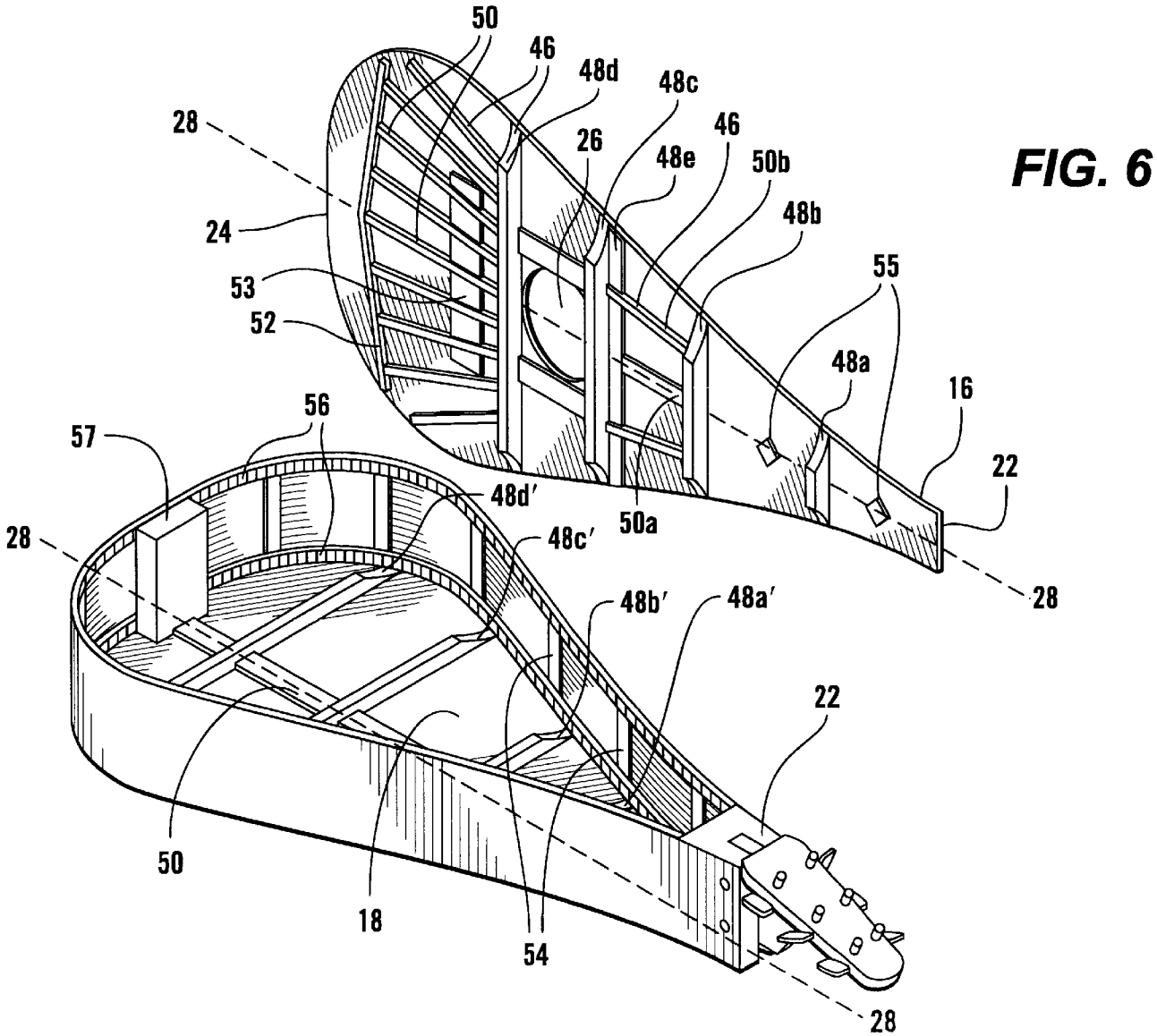
FIG. 6 is an exploded perspective view of the guitar shown in FIG. 1, revealing the supporting braces.

As seen in FIG. 6, the guitar 10 further comprises a support bracing 46 on the inside of the first surface 16, second surface 18 and the sides 20, connecting the first surface 16 to the second surface 18. The support bracing 46 is generally symmetrical along the longitudinal line 28–28'.

In general, the supporting bracing 46 forms reinforcement for the first and second surfaces 16, 18 and the sides 20 to prevent the first and second surfaces 16, 18 and sides 20 from buckling or flexing under the torsion forces of the strings 36. Generally, the support bracing 46 comprises a plurality of vertical braces 48, a plurality of horizontal braces 50, at least one V-shaped brace 52, at least one bridge patch 53 a plurality of column braces 54, at least one diamond shaped brace 55, a plurality of trim braces 56 and a tail block 57.

The support bracing 46 for the first surface 16 comprises vertical braces 48 positioned on either side of the circular opening 26 that are substantially parallel to each other. In one embodiment, at least five parallel braces 48*a*, 48*b*, 48*c*, 48*d* and 48*e* are constructed. Each vertical brace 48 increases in length from the top end 22 to the bottom end 28, substantially based on the tear-shape of the acoustic chamber 14, generally as shown in FIG. 6.

At least one horizontal brace 50 further reinforces the vertical brace 48. In one embodiment, at least one horizontal brace 50*a* is positioned generally in perpendicular orientation from the vertical brace 48 and at least one horizontal brace 50*b* is positioned in a non-perpendicular orientation, in about 45–90° from the vertical brace 48.

Further bracing towards the bottom end 24 of the guitar 10 is provided by a substantially V-shaped brace 52. In a preferred embodiment, the V-shaped brace 52 comprises at least two arms that are separated by an angle, which is generally 165°. In one embodiment, the two arms of the V-shaped brace 52 are substantially cuboid in shape. In another embodiment, the two arms of the V-shaped brace 52 are substantially trapezoid in shape. In yet another embodiment, the two arms of the V-shaped brace 52 have a substantially rectangular base with an arcuate third dimension.

In a preferred embodiment for the guitar 10, following is the arrangement for support bracing 46 for the first surface 16: The guitar 10 has at least five vertical braces 48 and at least one V-shaped brace 52. At least one diamond shaped brace 55 is positioned in between vertical braces 48*a* and 48*b*, and between the top end 22 and the vertical brace 48*a* along the longitudinal axis 28–28'. At least one horizontal brace 50*a* and at least two symmetrical horizontal braces 50*b* are positioned in between the vertical braces 48*b* and 48*e*. Vertical brace 48*c* is positioned adjacent to brace 48*e*. These three braces 48*e*, 48*c* and 48*d* provide added support to the first surface 16, especially around the opening 26, which forms the weakest point of this guitar. At least two horizontal braces 50*a* are positioned on either sides of the circular opening 26, such that the two horizontal braces 50*a* connect the vertical braces 48*c* and 48*d*. At least one bridge patch brace 53 is positioned in between the V-shaped brace 52 and vertical brace 48*d*. This bridge patch brace 53 is positioned such that it supports the saddle assembly 32 on the first surface 16 of the guitar 10. At least one horizontal brace 50*a* and at least two horizontal braces 50*b* are positioned between the vertical brace 48*d* and the V-shaped brace 52. These horizontal braces 50*a* and 50*b* are positioned such that they run over the bridge patch brace 53.

In another preferred embodiment for the present invention, the guitar 10 has the following supporting brace 46 for the second surface 18 and the sides 20: the sides 20, have a plurality of equally spaced column braces 54 all along the inside wall of the sides 20. These column braces 54, in one embodiment, are substantially cuboid in shape. In another embodiment these column braces 54 are substantially trapezoid in shape. In yet another embodiment, these column braces 54 have a rectangular base with arcuate third dimension.

The inside of the second surface 18, in one preferred embodiment, has at least four vertical braces 48 that are substantially equidistant from each other, the top end 22 and the bottom end 24. A tail block brace 57 is positioned at the bottom end 24. The tail block 57 is generally 7.5 cm wide 2 cm deep and is as tall as the side 20. The tail block 57 is positioned such that it is capable of receiving a peg (not shown), in the event that a user wants to place a strap (not shown) on the guitar 10. Additionally, the tail block 57 functions to form the meeting point for the first surface 16, and second surface 18 and the sides 20.

The four supporting braces 48 inside the second surface, i.e. 48*a*', 48*b*', 48*c*' and 48*d*' are substantially bisected by a horizontal brace 50 along the longitudinal line 28–28'. Each vertical brace 48 increases in length from the top end 22 to the bottom end 28, substantially based on the tear-shape of the acoustic chamber 14, generally as shown in FIG. 6. In one embodiment of the present invention, the vertical braces 48*a*', 48*b*', 48*c*' and 48*d*' are substantially trapezoid in shape. In another embodiment of the present invention, the vertical braces 48*a*', 48*b*', 48*c*' and 48*d*' are substantially cuboid in shape. In yet another embodiment of the present invention, the vertical braces 48*a*', 48*b*', 48*c*' and 48*d*' have a substantially rectangular base with an arcuate third dimension.

In a preferred embodiment, the side 20 and the first and the second surfaces, 16, 18, are also held in position by other supporting braces 46, such as by a plurality of trim braces 56. The trim brace 56 runs along the inside wall of the sides 20, and is positioned such that it forms the meeting interface between the first surface 16 and the side 20, and the second surface 18 and the side 20 except for the wall surface covered by the tail block 57. In a preferred embodiment, each trim bracing is generally cuboid in shape and has the following dimensions, 2.5 cm in length, 1 cm in width and 0.5 cm in depth. In another preferred embodiment, the trim brace 56 is a triangular volume in shape, such that the trim brace 56 forms a wedge between the surfaces 16, 18 and the sides 20. In a preferred embodiment, the trim brace 56 is glued to the side 20 and the first and second surfaces 16, 18.

In another embodiment, the trim brace 56 is held in position by small nails, at least 5 mm long.

Generally, the supporting braces 46 are constructed from substantially cuboid pieces of material, including natural, synthetic and man made materials. In one embodiment, the supporting braces are made from wood, and preferably rosewood, and are glued to the inside surface of the first surface 16, second surface 18 and the sides 20. In another embodiment the supporting braces 46 have a substantially rectangular base with an arcuate third dimension, for added resistance to torsional forces. In yet another embodiment, the supporting braces 46 are substantially trapezoid in shape.

Figure 4:
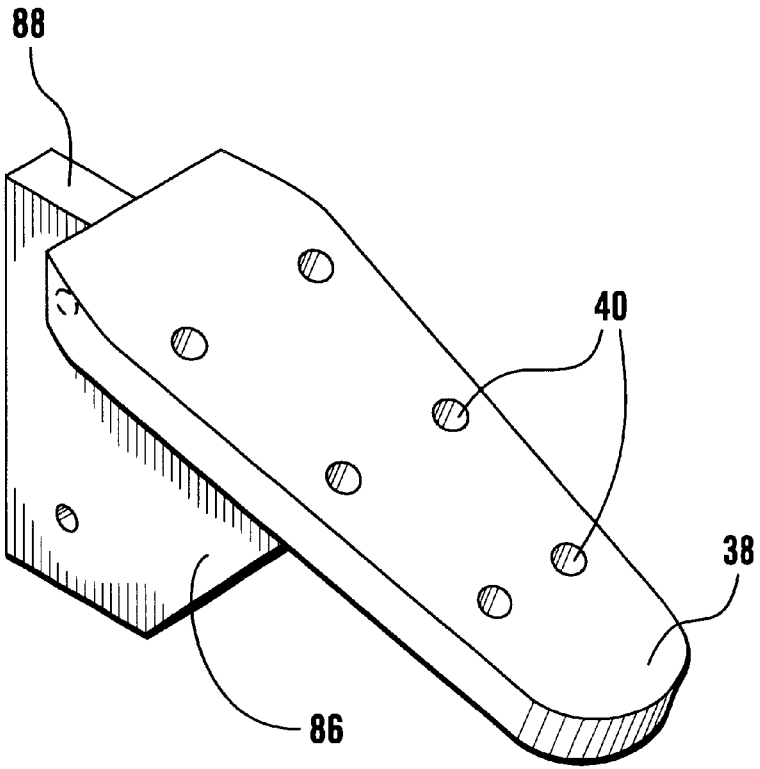
FIG. 4 is a perspective view of the peg head shown in FIG.2
Figure 3:
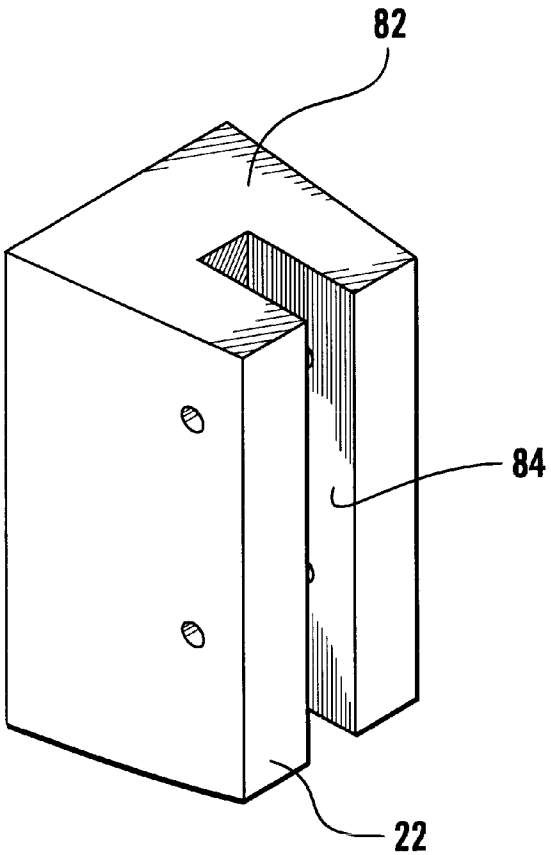
FIG. 3 is a perspective view of the peg head block shown in FIG.2.
Figure 5:
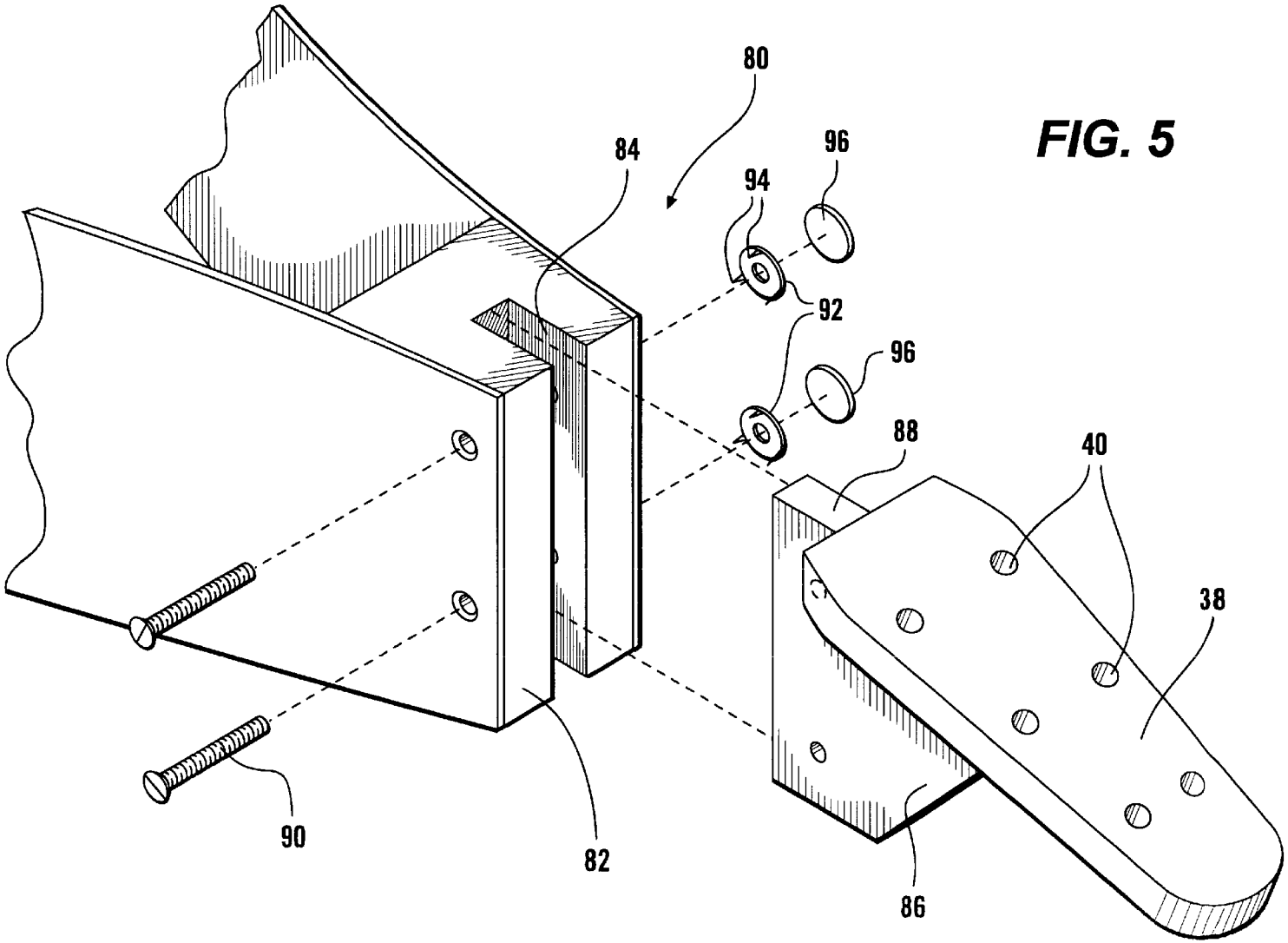
FIG. 5 is an enlarged exploded perspective view of the top end of the guitar shown in FIG. 1 wherein the peg head block and the peg head are capable of forming a mortise and tenon joint.

Now referring to FIGS. 2, 3, 4 and 5, the guitar 10 of the present invention has a novel attachment assembly 80 for attaching a guitar body 12 with the peg head 38 to the top end 22 of the chamber 14. The attachment assembly 80 includes a peg head block 82 that is positioned on the top end of the chamber 14. As seen in FIG. 3, the peg head block 82 is shaped substantially like a trapezoid having a substantially mortise cavity 84. The peg head 38, as seen in FIG. 4, is angularly and partially positioned on a gusset 86, such that the gusset 86 is partially covered. In one embodiment, a preferred angle between the peg head and the horizontal plane of the first surface 16 is about 15°. The exposed portion of the gusset 86 generally forms the tenon 88 such that the tenon 88 is capable of snuggly fitting into the mortise cavity 84 of the peg head block 82. The tenon 88 and the mortise cavity 84 generally form a dovetail arrangement.

The peg head 38, peg head block 82 and the gusset 84 in one preferred embodiment are constructed from wood. The peg head 38 and the gusset 84 are glued together by any commercial glue, for example YELLOW TITE-BOND ORIGINAL WOOD GLUE™, manufactured by Franklin International, Columbus Ohio, which is capable of joining the desirable materials of the peg head and the gusset. In another preferred embodiment, the peg head 38, peg head block 82 and the gusset 84 are held in position by the following arrangement: The peg head 38 is glued to the gusset 84 and the gusset 84 and the peg head block 82 are held in position by at least one bolt 90 and a T-nut 92. In a preferred embodiment, at least two bolts 90 and two t-nuts 92 are used. The T-nuts 92 are threaded and have at least one tooth 94, which digs into the body 12 of the guitar and therefore holds the bolt 90 and the nut 92 in position. A stopper 96 further covers the nut 92.

When the body 12 or head 38 is damaged and repair is necessary, the following steps may be desirable: first the stopper 96 is removed, then the nuts 92 and the bolts 90 are removed and finally the head 38 is gently removed from the mortise cavity 84. After repair, the head 38 can be reassembled with the body 12 by following the above-mentioned procedure in the reverse order. Such a process ensures that repairs can be made efficiently and quickly without dismantling the entire guitar 10.

Various embodiments of the neckless guitar of the present invention have many other applications aside from those described here. Thus, although the invention has been herein shown and described in what is perceived to be the most certain and preferred embodiments, it is to be understood that the invention is not intended to be limited to the specific embodiments set forth above. Rather, it is recognized that certain modifications, substitutions, alterations, and/or omissions may be made by one of skill in the art of the invention without departing from the spirit or intent of the invention. Accordingly, the invention is to be taken as including all reasonable equivalents to the subject matter of the appended claims, and the foregoing description is meant to be exemplary only and should not limit the scope of the invention set forth in the following claims.

What is claimed is:

1. A neckless guitar, comprising:

a tear-shaped guitar body, having a top end, a bottom end, a first surface having an opening, a second surface substantially parallel to the first surface, and a side connecting the first surface to the second surface, whereby a hollow, tear-shaped acoustic chamber is formed;

a fret board mounted on the first surface and positioned between the opening and the top end of the body;

a saddle assembly mounted on the first surface;

a nut assembly mounted on the top end of the chamber;

a peg head mounted on the top end of the body and having at least one receiving slot;

at least one tuning key passing through the receiving slot; and at least one string connected at one end to the saddle assembly and connected at its opposite end to the tuning key after passing over or through the nut assembly.

2. The neckless guitar of claim 1, wherein the first surface is fused with the side.

3. The neckless guitar of claim 1, wherein the second surface is fused with the side.

4. The neckless guitar of claim 1, wherein the first surface, second surface and the sides are fused together.

5. The neckless guitar of claim 1, further comprising a scratch guard, wherein the scratch guard is positioned substantially along the length of the fret board and partially surrounds the opening of the upper surface.

6. The neckless guitar of claim 1, further comprising supporting braces on the inside of the first surface, the second surface and the sides connecting the first surface to the second surface, wherein the supporting braces further comprise, a plurality of vertical braces;

a plurality of horizontal braces;

at least one V-shaped brace;

at least one bridge patch brace;

at least one diamond shaped brace;

at least one tail block brace;

a plurality of column braces; and a plurality of trim braces, wherein the plurality of vertical braces are positioned substantially perpendicular to an axis connecting the top end and the bottom end of the guitar;

wherein the plurality of horizontal braces are positioned substantially horizontal to an axis connecting the top end and the bottom end of the guitar;

wherein at least one V-shaped brace is positioned substantially towards the bottom end of the guitar;

wherein at least one bridge patch brace is positioned at the opposite side of a saddle assembly;

wherein at least one diamond shaped brace is positioned in between the top end and the vertical brace or between two vertical braces;

wherein at least one tail block brace is positioned on the side towards the bottom end whereupon the first surface, the second surface and the sides meet;

wherein the plurality of column braces are vertically positioned along the inside wall of the side; and wherein the plurality of trim braces are positioned along the interfaces of the first surface and the side and the second surface and the side.

7. A neckless guitar having a guitar body connected to a peg head by means of an attachment assembly, the attachment assembly comprising:

a peg head block, wherein the block is positioned on the top end of the body;

a peg head; and a gusset by which the peg head is coupled to the block.

8. A neckless guitar of claim 7, wherein the gusset couples the block and the peg head via a substantially dovetail arrangement.

9. A neckless guitar of claim 7, wherein the block is a trapezoid having a mortise cavity.

10. A neckless guitar of claim 7, wherein the peg head is partially positioned on the gusset at an angle and whereby the gusset is partially covered.

11. A neckless guitar of claim 10, wherein the partially covered gusset forms a tenon and couples to the mortise cavity of the block, whereby a substantial dovetail arrangement is formed.

12. A neckless guitar of claim 7, wherein the block, peg head and gusset are held together in position by a mechanism selected from a group consisting of at least one nut and bolt, a gluing agent and a bolt and a T-nut, whereby the block, peg head and gusset are dismantalable to perform repair.

13. A neckless guitar of claim 12, wherein the block and gusset are held together by at least one bolt and a T-nut.

14. A neckless guitar of claim 13, wherein the gusset and the peg head are held together by a gluing agent.

15. The neckless guitar of claim 7, further comprising supporting braces on the inside of the guitar body comprising a first surface, a second surface and sides connecting the first surface to the second surface, wherein the supporting braces further comprise, a plurality of vertical braces;

a plurality of horizontal braces;

at least one V-shaped brace;

at least one bridge patch brace;

at least one diamond shaped brace;

at least one tail block brace;

a plurality of column braces; and a plurality of trim braces, wherein the plurality of vertical braces are positioned substantially perpendicular to an axis connecting a top end and a bottom end of the guitar;

wherein the plurality of horizontal braces are positioned substantially horizontal to an axis connecting the top end and the bottom end of the guitar;

wherein at least one V-shaped brace is positioned substantially towards the bottom end of the guitar;

wherein at least one bridge patch brace is positioned at the opposite side of a saddle assembly on the first surface of the guitar;

wherein at least one diamond shaped brace is positioned in between the top end and the vertical brace or between two vertical braces;

wherein at least one tail block brace is positioned on the side towards the bottom end whereupon the first surface, the second surface and the sides meet;

wherein the plurality of column braces are vertically positioned along the inside wall of the side; and wherein the plurality of trim braces are positioned along the interfaces of the first surface and the side and the second surface and the side.

* * * * *